United States Patent [19]

Simpson

[11] 3,960,625

[45] June 1, 1976

[54] HEAT INSULATING ASSEMBLY AND METHOD FOR MAKING SAME

[75] Inventor: Robert Scott Simpson, Houston, Tex.

[73] Assignee: Reichhold Chemicals, Inc.

[22] Filed: Dec. 23, 1974

[21] Appl. No.: 535,997

[52] U.S. Cl. ..... 156/79; 52/618; 156/92; 156/242; 156/279; 264/115; 264/145; 264/171

[51] Int. Cl.[2] ..... B29D 9/00

[58] Field of Search ..... 52/200, 18, 616, 202, 52/309, 615, 618, 619, 407, 409; 156/79, 92, 242, 279; 264/115, 145, 171

[56] References Cited

UNITED STATES PATENTS

| | | | |
|---|---|---|---|
| 3,267,626 | 8/1966 | Daly | 52/619 X |
| 3,358,408 | 12/1967 | Cooper, Jr. et al. | 52/202 |
| 3,732,656 | 5/1973 | Robinsky | 52/618 X |

*Primary Examiner*—Ernest R. Purser
*Assistant Examiner*—Carl D. Friedman
*Attorney, Agent, or Firm*—Pravel & Wilson

[57] ABSTRACT

A heat insulating assembly and method for making same, the heat insulating assembly adapted to be mounted with a building, and having a first panel with a second panel secured thereto, forming a continuous open gap adjacent each open end of the second panel wherein an end closure member closes each of the continuous open gaps adjacent the open ends to substantially, fully enclose the area between the panels for providing an insulating air-space therebetween.

1 Claim, 3 Drawing Figures

HEAT INSULATING ASSEMBLY AND METHOD FOR MAKING SAME

BACKGROUND OF THE INVENTION

The field of this invention is heat insulating assemblies and methods for making same, particularly of the type used for translucent, heat-insulating skylights.

In the area of assemblies such as those used for skylights, it is desirable to have a panel that is not only translucent but also has heat-insulating qualities. However, prior art one-piece skylight panels suffer because they have no insulating characteristics, consequently resulting in significant heat losses in areas adjacent thereto. Furthermore, the non-insulating, one-piece skylight panels have problems associated with condensation forming on the interior surface thereof due to thermal differences between the exterior and interior portions thereof.

In attempts to solve these problems, the prior art includes plural panel assemblies such as those disclosed in U.S. Pat. No. 3,358,408. Numerous disadvantages are found in the prior art such as unequal expansion and contraction rates resultant to the plural panels being constructed of differing materials, requirements of using expensive molding techniques in lieu of less expensive continuous line production, as well as critical tolerances being mandatory at connecting lips for proper sealable engagement of adjacent multiple panels for proper sealing thereof.

SUMMARY OF THE INVENTION

The present invention relates to a new and improved heat insulating assembly and method for making same, the assembly having a first panel adapted to be mounted with the building, a second panel having a base, upstanding longitudinal sides, and open ends and the second panel being secured to the first panel by the longitudinal sides forming a continuous open gap at each end of the second panel adjacent to the open ends, and having an end closure member for closing each of the continuous open gaps to substantially fully enclose the area between the panels for providing an insulating air-space therebetween.

DESCRIPTION OF THE PREFERRED EMBODIMENT

Figure 1:
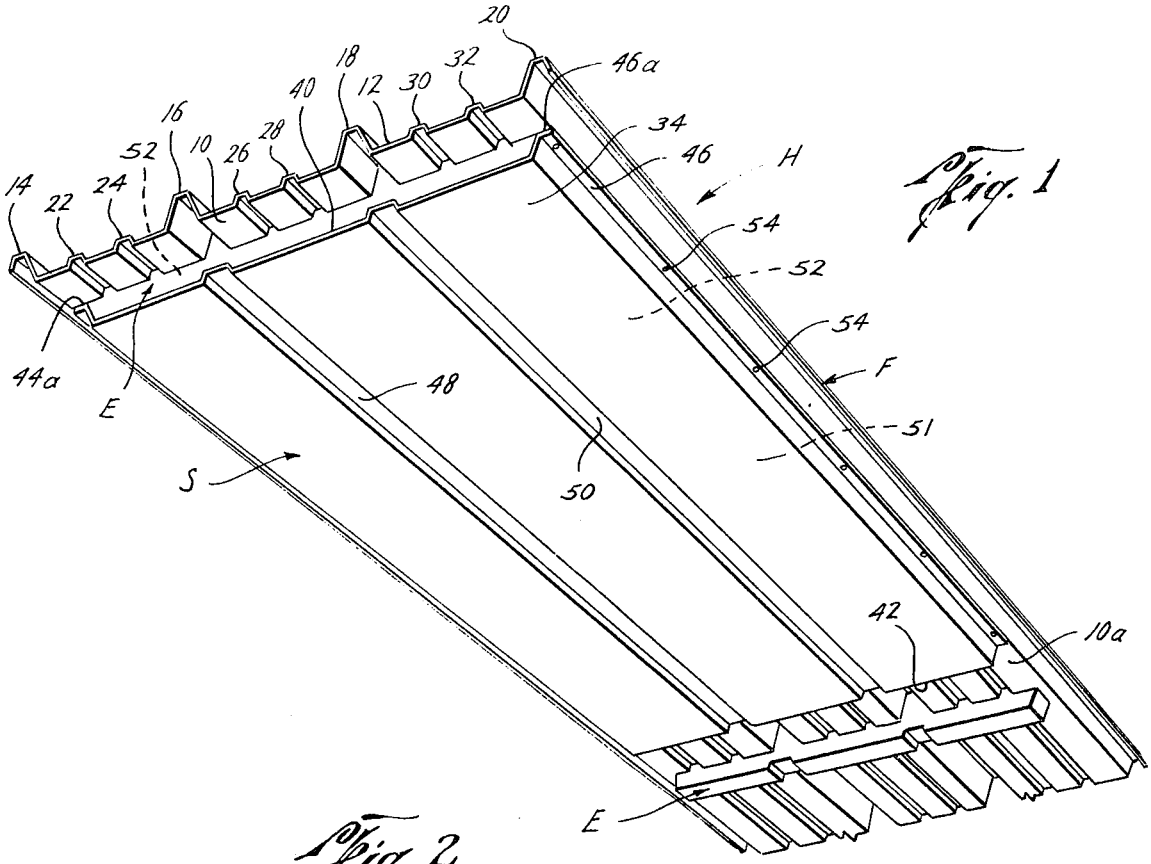
FIG. 1 is an isometric view of the heat insulating assembly of the preferred embodiment of this invention.

Referring to the drawings, the letter H refers to the heat insulating assembly of the present invention. The heat insulating assembly H is adapted to be mounted with a building and has a first panel F and a second panel S secured thereto forming a continuous open gap therebetween which is closed by an enclosure means E to fully enclose the area between the panels F, S for providing an insulating air-space therebetween.

The heat insulating assembly H has a first panel F adapted to be mounted with a building (not shown).

The first panel F has an interior surface 10 and an exterior surface 12. The first panel F has major, longitudinal corrugations 14, 16, 18, 20 and minor longitudinal corrugations 22, 24, 26, 28, 30 and 32. Major longitudinal corrugations 16, 18 are centrally formed in the first panel F having interior surfaces (not numbered) formed in any desired configuration. Major longitudinal corrugations 14 and 20 establish the end portions of the first panel F with the corrugations 14, 20 having similarly formed adjacent surfaces 14*a* and 20*a*, 14*b* and 20*b*, and 14*c* and 20*c*, respectively, thereof for mounting the first panel F either with a building (not shown) or adjacent to another panel assembly H. Preferably, the corrugations 14, 16, 18, 20, 22, 24, 26, 28, 30, 32 conform to the configuration of metal siding and roofs of a building (not shown) to aid in attaching the assemblies H thereto.

The second panel S includes a base 34, upstanding, parallel, longitudinal sides 36, 38 and open ends 40, 42 formed therewith. Longitudinal side edges 44, 46 are formed adjacent to upstanding, parallel, longitudinal sides 36, 38, respectively. The base 34 has longitudinal corrugations 48, 50 providing a configuration having interior surfaces (not shown) of any desired form. Disposed therebetween longitudinal corrugations 48, 50 and upstanding longitudinal sides 36, 38, are inner surface base portions 34*a*.

The second panel S is secured to the first panel F by interior surfaces 44*a*, 46*a* of longitudinal side edges 44, 46, respectively, engaging the flat surfaces 10*a*, 10*b* of interior surface 10 of the first panel F. Commercially available double coated foam tape having a pressure sensitive adhesive such as Adhesive Tape Number Y-4046 manufactured by the 3-M Company is used to seal the second panel S with the first panel F but other sealing means may be used. Thus, cavity 51 is formed between the first panel F and the second panel S with the base 34 of the second panel S in a spaced relationship of preferably one inch from the interior surface 10 of the first panel F and having a continuous open gap 52 adjacent the open ends 40, 42 of the second panel S. Suitable mechanical fasteners 54 such as screws, bolts and nuts, rivets, or the like may be used to further enhance the connection therebetween the first panel F and the second panel S.

Enclosure means E includes closure member 56 preferably formed of a foam rubber or other suitable material for sealing open ends 40, 42 adjacent the second panel S. Preferably, the closure member 56 substantially fully encloses the area between the first panel F and the second panel S and is of a unitary structure which extends into at least two adjacent corrugations formed in the first panel F. In particular, the closure member 56 preferably has a first surface 56*a* which substantially conforms to the configuration of interior surface 10 having flat surfaces 10*a*, and projections (not numbered) corresponding to corrugations 16, 18, 22, 24, 26, 28, 30, 32 formed in the first panel F. Second surface 56*b*, in similar fashion conforms to the interior configuration of the second panel S having projections (not numbered) engaging interior portion 36*a* of the upstanding longitudinal side 36, interior portions 34*a* of the base 34, corrugations 48, 50, and interior surface 38*a* of upstanding longitudinal side 38. Thus, a single, unitary closure member 56 preferably engages all corrugations and surfaces adjacent open ends 40, 42 thus closing the same to substantially fully enclose the cavity 51 between the first panel F and the second panel S for providing an insulating air-space therebetwen. Commercially available contact-type adhesive such as Number 4693 manufactured by the 3-M Company is preferably used to seal and secure the end closure means E to the panels F, S, but other securing means may be employed.

Figure 2:
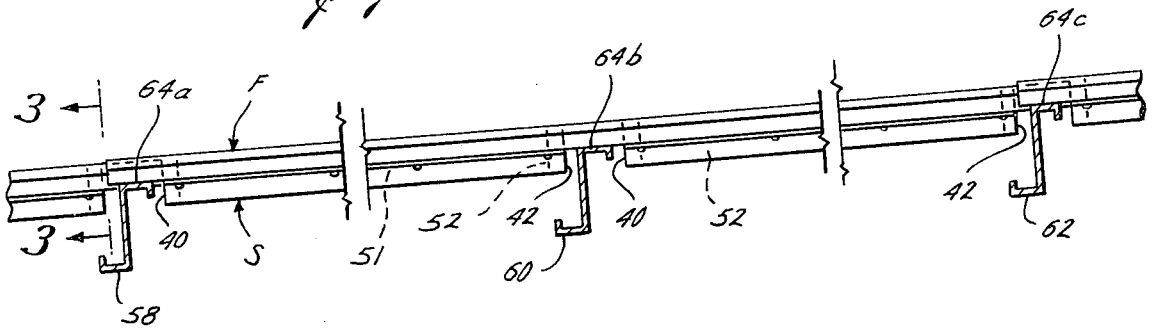
FIG. 2 is a side elevation of a roof construction showing the heat insulating assembly of FIG. 1 mounted therewith; and, FIG. 3 is an end view taken along the line 3—3 of FIG. 2, showing the preferred embodiment of this invention.
Figure 3:
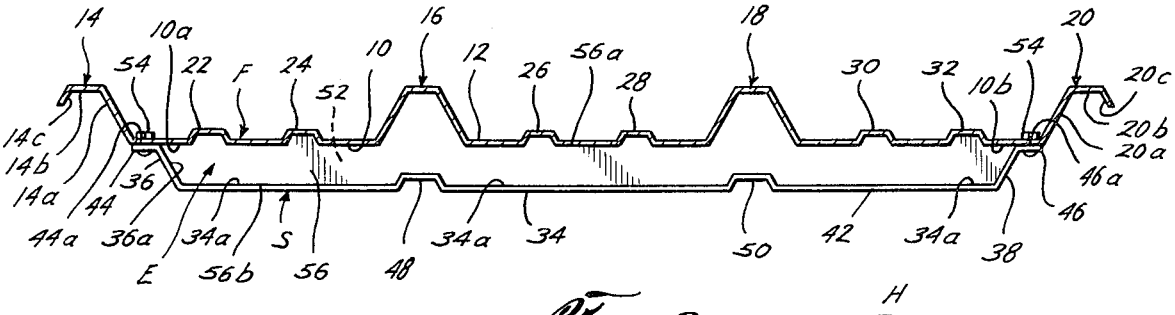

As best shown in FIG. 2, transverse roof purlins 58, 60, 62 underlie and support the heat insulating assemblies H of the present invention by the purlins 58, 60, 62 engaging support portions 64*a*, 64*c* of the first panel F adjacent either the ends 40, 42 and/or centrally thereof by support portion 64*b*. Furthermore, at support portions 64*a*, 64*c* adjacent assemblies may be suitable connected thereto such that corresponding corrugations and surfaces are in identical matched relationship for appropriate mounting thereof. Furthermore, the assemblies H may be used for a wall structure as well as for a roof structure.

Preferably, the first and second panels F, S are formed of fiberglass reinforced polyester in separate operations on a continuous production line of the type well-known in the art. Although there are other alternative methods of forming the panels F, S such as press molding, the continuous production line is most preferred. Basically, this continuous production line includes the basic stages of: (1) a bottom sheet of cellophane or other film is payed off; (2) a layer of polyester resin blended with various monomers, pigments, promoters, catalysts and other additives is pumped onto the moving sheet of film with the thickness and uniformity of the resin layer being controlled by a doctor blade; (3) glass fiber roving is fed into rotary choppers and the chopped strands are deposited by gravity on the resin layer; (4) chain saturators are used to force the glass into the resin; (5) the top sheet of cellophane or other film is placed on top of the moving laminate in such a way as to prevent entrapment of air; (6) the moving "sandwich" is heated and passes through forms or dies to give it the desired cross-sectional shape; (7) further heating causes gelling the resin; (8) the laminate is moved through temperature controlled ovens where the resin cures; (9) the edges of the moving sheet is trimmed with saws; and, (10) the film is stripped away and a moving end-cut saw cuts the material panels to proper desired length.

Thus, as hereinabove described, the heat insulating assembly H includes disposing the second panel S having its longitudinal upstanding sides 36, 38 on surfaces 10*a*, 10*b* of the first panel F with corresponding surfaces 44*a*, 46*a*. The panels F, S are sealably secured providing a continuous open gap 52 therebetween which not only extends along the lengths of the panel F, S but also adjacent to open ends 40, 42. The open gaps 40, 42 thereafter, are closed with closure member 56 forming a substantially fully enclosed area between panels F, S for providing an insulation air-space therebetween.

Thus, the components of the heat insulating assembly H, preferably to be used as a skylight, is inexpensively manufactured on a continuous line production rather than requiring more expensive molding techniques. Furthermore, being sealably engaged about all adjoining surfaces, the assembly H tends to reduce condensation from developing within the continuous open gap 52 as well as providing substantial insulation to protect against heat loss-gain because of the isolated dead air space therebetween. Continuous manufacturing production of panels F, S allows panels of any length to be manufactured without the requirements of new tooling thereof. Furthermore, inasmuch as both panels F, S are made of the same material, problems encountered with differing expansion and contraction rates due to temperature changes are consequently minimized.

The foregoing disclosure and description of the invention are illustrative and explanatory thereof, and various changes in the size, shape, and materials as well as in the details of the illustrated construction may be made without departing from the spirit of the invention.

I claim:

1. A method of forming heat insulating skylight assemblies using a first panel of fiberglass reinforced polyester having a plurality of corrugations and a second panel of fiberglass reinforced polyester having a plurality of corrugations, comprising the steps of:

forming the second panel by initially forming a continuous strip of the fiberglass reinforced polyester corrugated panel material including the basic stages of paying off a bottom sheet of cellophane or other film;

pumping a layer of polyester resin blended with various monomers, pigments, promoters, catalysts and other additives onto the moving sheet of film with the thickness and uniformity of the resin layer being controlled by a doctor blade;

feeding glass fiber roving into rotary choppers and depositing the chopped strands by gravity on the resin layer;

forcing the glass into the resin with chain saturators;

placing a top sheet of cellophane or other film on top of the moving laminate in such a way as to prevent entrapment of air;

heating and passing the moving laminate through forms or dies to give it the desired cross-sectional shape;

further heating to cause gelling of the resin;

moving the laminate through temperature controlled ovens where the resin cures;

trimming the edges of the moving sheet with saws; and stripping away the film and cutting the material panels with a moving end-cut saw to proper desired length to provide a panel of uniform cross-section throughout its length;

disposing the second panel having a base, upstanding longitudinal sides, and open ends, with its corrugations spaced from the corrugations of a first panel with its longitudinal side edges on a surface of the first panel;

securing the longitudinal side edges of the second panel to the first panel with mechanical fasteners with sealing of the longitudinal edges between the second panel with the first panel to prevent fluid migration therebetween with double coated foam tape to provide a continuous open gap between the second panel and the first panel at each open end thereof;

closing the continuous open gap adjacent each of the open ends of the second panel by filling the continuous open gap with unitary foam rubber end closures to form a substantially fully enclosed area between said panels for providing an insulating air-space between said panels and each of said foam rubber end closures including a unitary seal with first and second surfaces which substantially conforms to the contacted surfaces of the first and second panels to extend into said corrugations formed in the first and second panels and into contact with the opposed surfaces of the first and second panels; and securing the first and second end closures to the first and second panels with contact-type adhesive.

* * * * *